US006615712B2

(12) United States Patent
Faitel et al.

(10) Patent No.: US 6,615,712 B2
(45) Date of Patent: Sep. 9, 2003

(54) MECHANICAL PRESS DRIVE

(75) Inventors: William M. Faitel, New Baltimore, MI (US); Douglas J. Schrandt, Chesterfield Township, MI (US); Joseph K. Schlafhauser, Troy, MI (US)

(73) Assignee: Unova IP Corp., Woodland Hills, CA (US)

( * ) Notice: Subject to any disclaimer, the term of this patent is extended or adjusted under 35 U.S.C. 154(b) by 0 days.

(21) Appl. No.: 09/997,149

(22) Filed: Nov. 29, 2001

(65) Prior Publication Data

US 2002/0069770 A1 Jun. 13, 2002

Related U.S. Application Data

(60) Provisional application No. 60/255,282, filed on Dec. 11, 2000.

(51) Int. Cl.[7] ..... B30B 1/18

(52) U.S. Cl. ..... 100/269.2; 100/230; 100/269.19; 100/289

(58) Field of Search ..... 100/230, 269.2, 100/269.19, 284

(56) References Cited

U.S. PATENT DOCUMENTS

| | | | | | |
|---|---|---|---|---|---|
| 50,494 | A | * | 10/1865 | Ryner | 100/127 |
| 216,392 | A | * | 6/1879 | Gardner | 100/230 |
| 240,912 | A | * | 5/1881 | Leavitt | 100/230 |
| 954,449 | A | * | 4/1910 | Mead | 100/230 |
| 3,741,108 | A | | 6/1973 | Stratman | 100/229 |
| 3,908,712 | A | * | 9/1975 | Paletzki | 140/1 |
| 3,921,515 | A | | 11/1975 | Eckerle et al. | 100/229 |
| 4,413,555 | A | | 11/1983 | Swinney | 100/214 |
| 4,823,687 | A | * | 4/1989 | Yonezawa et al. | 100/346 |
| 4,827,839 | A | * | 5/1989 | Yonezawa et al. | 100/346 |
| 4,873,923 | A | * | 10/1989 | Manning | 100/258 R |
| 5,467,707 | A | * | 11/1995 | Kanamaru | 100/292 |
| 5,669,296 | A | * | 9/1997 | Newton | 100/99 |
| 6,301,768 | B1 | | 10/2001 | Toeniskoetter | |

FOREIGN PATENT DOCUMENTS

| | | |
|---|---|---|
| DE | 2356517 | 5/1975 |
| JP | 05329690 | 3/1994 |
| JP | 10272598 | 10/1998 |

* cited by examiner

*Primary Examiner*—William Hong
(74) *Attorney, Agent, or Firm*—Reising, Ethington, Barnes, Kisselle, P.C.

(57) ABSTRACT

A mechanical press drive that uses a ballscrew apparatus to move the upper platen of a press upward and downward. A first coupling is connected to a screw of the ballscrew apparatus and connects the screw to one of a movable platen of a press or a stationary member of the press. A second coupling is connected to and couples a nut of the ballscrew apparatus to the other of the platen and the stationary member of the press. A drive motor is operably connected to one of the nut and screw and relatively rotates them to impart reciprocal motion to a movable press platen coupled to the other of the nut and screw. The two couplings cooperatively isolate the ballscrew apparatus from offset and moment loading that may occur during press operation.

6 Claims, 4 Drawing Sheets

MECHANICAL PRESS DRIVE

REFERENCE TO RELATED APPLICATION

This application claims the benefit of provisional patent application U.S. Ser. No. 60/255,282, filed Dec. 11, 2000.

BACKGROUND OF THE INVENTION

1. Field of the Invention

This invention relates generally to a mechanical press drive for moving the upper platen of a press up and down.

2. Description of the Related Art Including Information Disclosed Under 37 CFR 1.97 and 1.98

Presses used for hemming operations are well known in the art. Such a press will exert forces exceeding 200,000 pounds and will typically use a hydraulic cylinder to raise and lower an upper platen and die assembly of the press. Increasingly, facilities that use presses are desirous of replacing their hydraulic drives with mechanical drives that incorporate ballscrews. A mechanical drive has the advantage of being more environmentally friendly than a hydraulic drive because mechanical drives are not prone to hydraulic fluid leaks and don't present hydraulic fluid disposal problems. Additionally, a mechanical drive consumes less energy than a hydraulic drive, and is quieter in operation. Finally, a mechanical drive is more reliable and thus experiences less down time, and can be designed with positive positioning and positive position holding features.

A ballscrew can be incorporated into a mechanical drive for a press. Ballscrew driven presses have disadvantages that have prevented wider use of ballscrew driven presses. The interface between the shaft or screw portion of a ballscrew apparatus and its ballscrew nut is sensitive to offset or moment loads, and such loads can cause a ballscrew drive to fail prematurely. As a result, if a press platen is not balanced, it can present an offset load to the ballscrew that can cause it to fail. Although care can be taken to ensure that offset loads or moments are minimized through the design of the press and of the tooling, it is impossible to guarantee that the press will never be subjected to unbalanced loads by the end user. Another source of an unbalanced load is the possibility of a tool or other foreign object being accidentally left on the lower die in an open press, that, when the press is cycled to a closed position, will exert a large unbalanced load on the upper die assembly or platen. Accordingly, it would be desirable to provide a mechanical press drive that incorporates a ballscrew apparatus that's not susceptible to damage when unbalanced loads are applied to the platen.

BRIEF SUMMARY OF THE INVENTION

The invention is a mechanical press drive for moving the upper platen of a press up and down. The press drive includes a ballscrew apparatus comprising a nut and a screw threadedly engaging the nut. The mechanical press drive also includes a first coupling connected to the screw and configured to connect the screw to one of a movable platen of a press or a stationary member of the press. A second coupling is connected to the nut and is configured to connect the nut to the other of the platen and the stationary member of the press. A drive motor is operably connected to one of the nut and screw and is configured to relatively rotate the nut and screw and impart reciprocal motion to the movable platen.

The two couplings are configured to cooperatively isolate the ballscrew apparatus from offset and moment loading that may occur during press operation. The couplings isolate the ballscrew apparatus while transmitting driving torque about the longitudinal axis of the ballscrew and forces along the longitudinal axis to the platen. Preferably, the couplings are gimbals.

Objects, features and advantages of this invention include providing a mechanical press drive that uses a ballscrew apparatus to raise and lower a movable platen and that isolates the ballscrew apparatus from offset or moment loads, and providing such a mechanical press drive that includes gimbals mounted on screw and nut portions of the ballscrew apparatus, respectively, to isolate the ballscrew apparatus from offset or moment loads, and is rugged, durable, economical and in service has a long useful life.

BRIEF DESCRIPTION OF THE SEVERAL VIEWS OF THE DRAWINGS

These and other objects, features and advantages of this invention will be apparent from the following detailed description of the preferred embodiment(s) and best mode, appended claims, and accompanying drawings in which:

DETAILED DESCRIPTION

Figure 1:
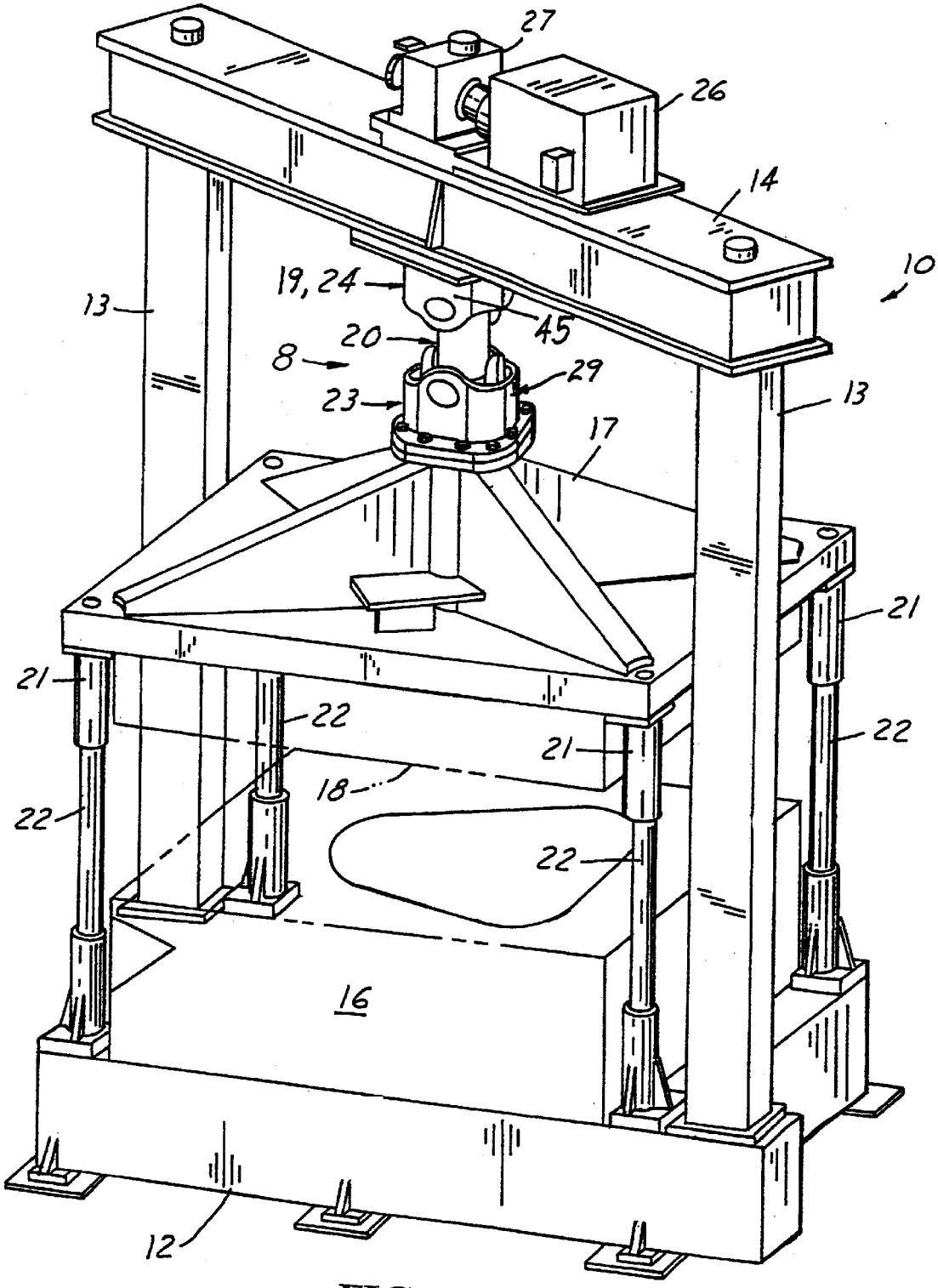
FIG. 1 is a perspective view of a mechanical press drive constructed according to the invention and installed in a press.
Figure 2:
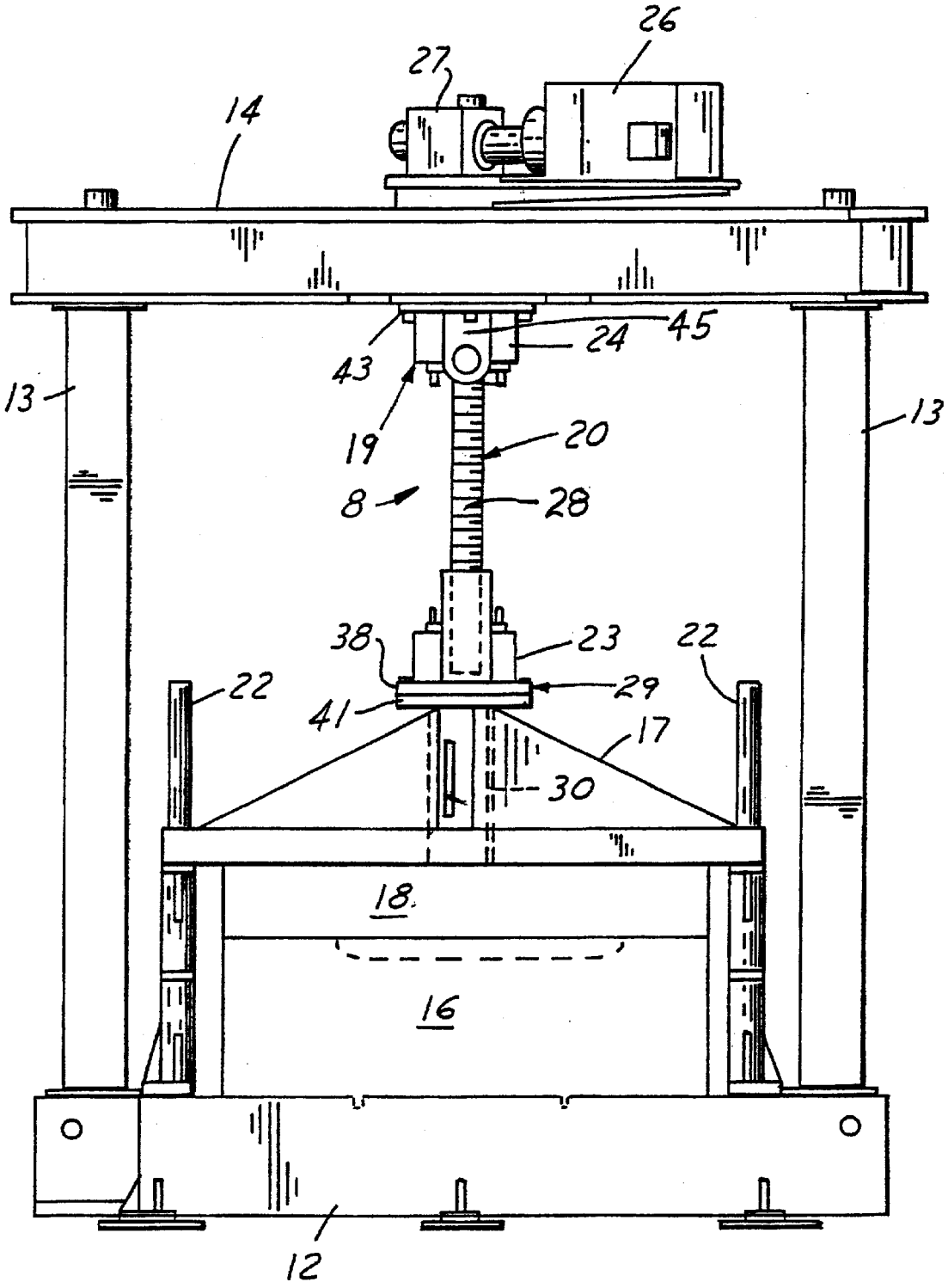
FIG. 2 is a side view of the press of FIG. 1 with a platen of the press in a lowered position.

FIGS. 1 & 2 illustrate a mechanical press drive 8 constructed according to a preferred embodiment of the invention for moving the platen 17 of a press 10. The press drive 8 comprises a ballscrew apparatus 20 including a ballscrew nut 32 and a ballscrew shaft or screw 28 threadedly engaging the nut 32. The drive 8 also includes a first coupling 19 that is connected to the screw 28 and connects the screw 28, either directly or indirectly, to one of a movable platen 17 of a press 10 or a stationary member 14 of the press. A second coupling 29 is connected to the nut 32 and connects the nut 32 either directly or indirectly to the other of the platen 17 and the stationary member 14 of the press. A drive motor 26 is operably connected to one of the nut 32 and screw 28 and drives it to produce reciprocal motion of a press platen 17 that is coupled to the other of the nut 32 and screw 28. The drive motor 26 produces the reciprocal motion of the platen 17 by rotating one of the nut 32 and screw 28 relative the other which moves the nut 32 and screw 28 through relative reciprocal motion parallel to a longitudinal axis of the screw 28. The two couplings 19, 29 cooperatively isolate the ballscrew apparatus 20 from offset and moment loading that may occur during press operation while transmitting driving torque about the longitudinal axis of the screw 28 and transmitting forces along that axis to move the platen.

The press 10 shown incorporating the preferred mechanical press drive embodiment 8 comprises a base 12 and two vertical frame members or legs 13 that support a stationary member in the form of a press crown 14. To guide movement of the platen 17 it has in each corner a cylindrical bushing 21 which slidably receives an upstanding guide post 22 mounted on each corner of the base 12. The ballscrew apparatus 20 suspends the upper platen 17 from the crown 14. The second or lower coupling 29 includes a lower gimbal 23 that connects or couples the nut 32 of the ballscrew apparatus 20 to the upper platen 17. The first or upper coupling 19 includes an upper gimbal 24 that connects or couples an upper end of the screw or shaft portion 28 of the ballscrew to a vertical driveshaft 25. The motor 26 is mounted on the crown 14, and is coupled to a gearbox 27. The output of the gearbox 27 is coupled to the vertical driveshaft 25.

As shown in FIG. 2, a lower die 16 of the press 10 is mounted on a center portion of the base 12 and an upper die 18 of the press 10 is mounted on the upper platen 17. The upper die 18 will cooperate with the lower die 16 to form a workpiece placed between the dies 16, 18 into a desired configuration as is well known in the art. The upper platen 17 is formed with a vertical tunnel 30 that can receive a lower end of the ballscrew shaft 28.

Figure 3:
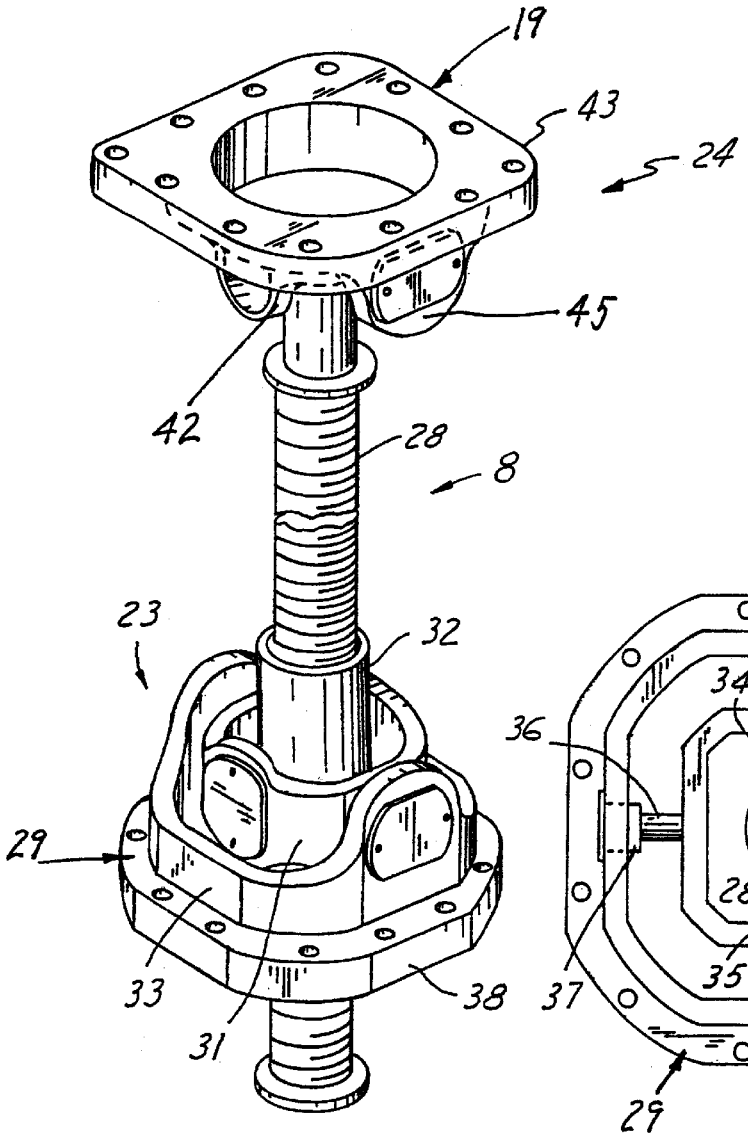
FIG. 3 is a perspective view of a ballscrew apparatus and first and second gimbals of the press drive of FIG. 1 with the first and second gimbals connected to screw and ballscrew nut portions of the apparatus, respectively.
Figure 4:
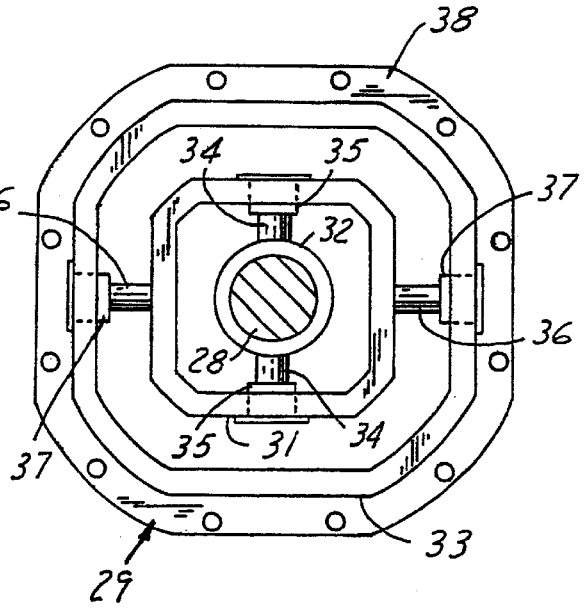
FIG. 4 is a detailed plan view of the second or lower gimbal connected to the ballscrew nut.

As shown in FIGS. 3 and 4, the lower gimbal 23 comprises an inner trunion 31 and an outer trunion 33. As is best shown in FIG. 4, a first pair of stub shafts 34 attaches the inner trunion 31 to the ballscrew nut 32. The stub shafts 34 extend from the nut 32 and are pivotally mounted in inner trunion bearings 35 carried by a ring or frame of the inner trunion. A second pair of stub shafts 36 that extend from the inner trunion 31 couples the outer trunion 33 to the inner trunion 31. The second pair of stub shafts 36 is pivotally mounted in outer trunion bearings 37 carried by a lower mounting ring or frame 38 of the outer trunion 33. Bolts couple the lower mounting ring 38 to a mounting flange 41 formed on a top surface of the upper platen 17.

Figure 5:
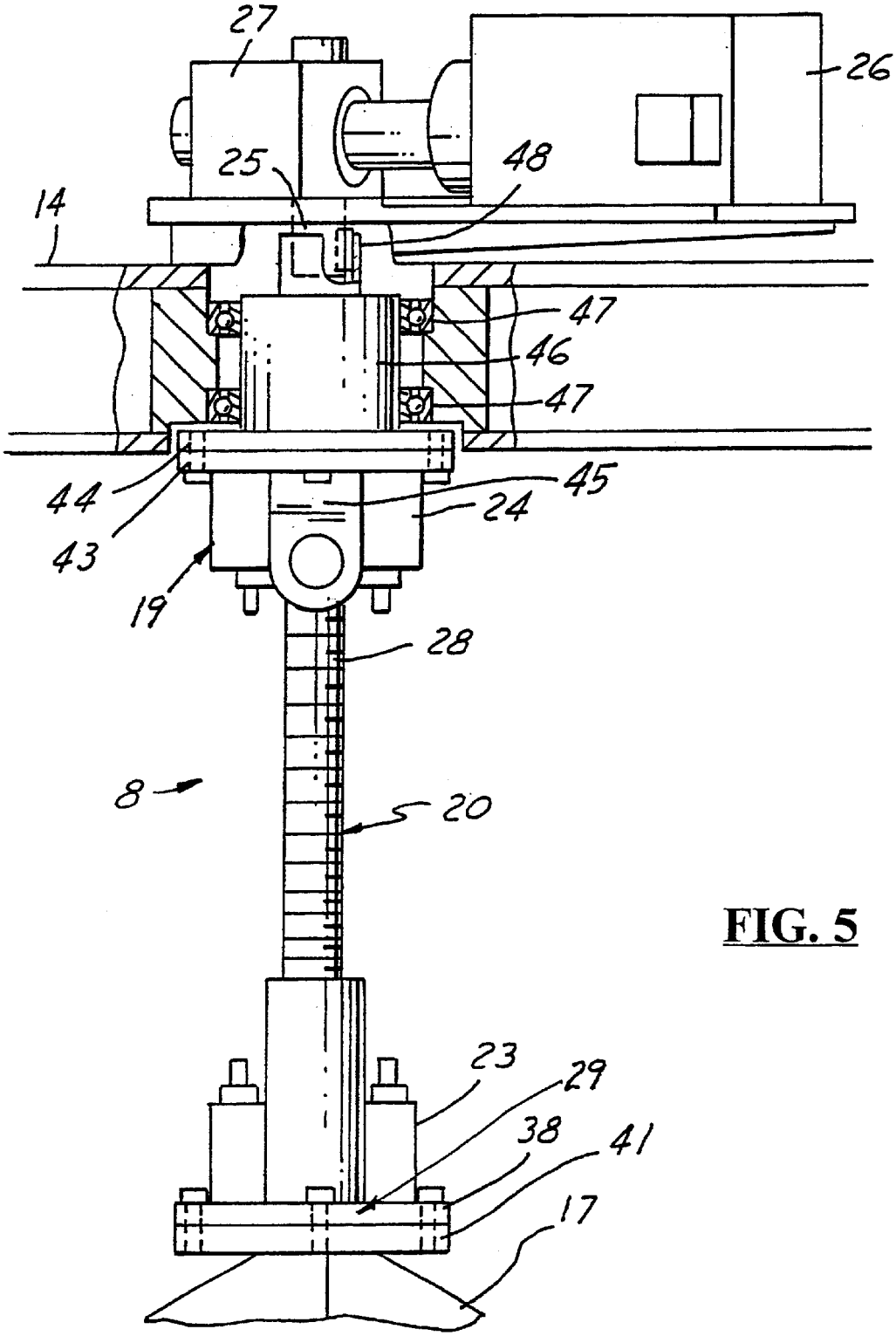
FIG. 5 is a fragmentary front view of the press and press drive of FIG. 1 with a crown of the press cut-away to provide a partial cross-sectional view of details of a coupling between the first or upper gimbal and a drive motor.

FIG. 5 most clearly shows how the gearbox 27 and the upper end of the ballscrew shaft 28 are operably connected through the upper gimbal 24. The upper gimbal 24 is similar in construction to the lower gimbal apparatus 23 and comprises an inner trunion 43 and an outer trunion 45 that are pivotally coupled to one another. The upper end of the ballscrew shaft 28 is coupled to the inner trunion 42 of the upper gimbal 24. An upper mount in the form of an upper mounting ring 43 of the outer trunion 45 of the upper gimbal 24 is attached by bolts to a mounting flange 44 on a lower end of a thrust shaft 46. A pair of thrust bearings 47 are used to mount and journal for rotation the thrust shaft 46 in the crown 14 of the press. The vertical driveshaft 25 from the gearbox 27 is keyed to a drive socket 48 formed on an upper end of the thrust shaft 46. The thrust shaft 46 and the thrust bearings 47 isolate the gearbox 27 from compressive forces that the ballscrew apparatus 20 generates, in a manner well known in the art.

Connecting the upper and lower gimbal assemblies 23, 24 between the ballscrew nut 32 and the upper platen 17, and between the thrust shaft 46 and the ballscrew shaft 28, respectively, isolates the ballscrew shaft 28 and ballscrew nut 32 from moment loads that the press 10 may create. Consequently, unbalanced loads on the upper platen 17 will not be communicated to the interface between the ballscrew shaft 28 and ballscrew nut 32. This enhances the suitability of a ballscrew drive for press applications.

Other couplings may be substituted for the gimbal assemblies 23 and 24 without departing from the spirit and scope of the invention. For example, any coupling that transmits driving torque about the longitudinal axis of the ballscrew shaft 28 and transmits thrust and pull forces along that axis may be substituted for one or both of the gimbal assemblies 23, 24.

This description is intended to illustrate certain embodiments of the invention rather than to limit the invention. Therefore, it uses descriptive rather than limiting words.

Obviously, it's possible to modify this invention from what the description teaches. Within the scope of the claims, one may practice the invention other than as described.

What is claimed is:

1. A mechanically driven press for performing hemming operations comprising:

a base and a lower platen mounted on the base;

at least two vertical frame members attached to the base;

a crown attached to the top of the vertical frame members;

a drive motor mounted in a fixed position rigidly attached to the crown, the motor having an output shaft;

a movable platen on the press that is driven in a vertical path between open and closed positions by the drive motor;

at least two fixed guidance members for the movable platen rigidly attached to the press for guiding the vertical motion of the movable platen between open and closed positions;

at least two engagement means on the movable platen for engaging the at least two fixed platen guidance members for preventing any horizontal motion of the movable platen;

a ballscrew apparatus including an elongated screw and a nut threadedly engaging the elongated screw, the ballscrew apparatus being configured to suspend the movable platen from the crown;

a first coupling connected to the elongated screw and configured to couple the screw to one of the movable platen or the crown of the press;

a first gimbal joint comprising the first coupling;

a second coupling connected to the nut and configured to couple the nut to one of the movable platen or the crown of the press; and, a second gimbal joint comprising the second coupling, the first and second gimbal joints each comprising a mechanical frame containing two mutually perpendicular axes of rotation, wherein one of the gimbal joints transmits rotary motion from the drive motor to one of the elongated screw or the nut of the ballscrew apparatus;

whereby the drive motor is operably connected to one of the screw or the nut, the drive motor being configured to relatively rotate the elongated screw or the nut to impart reciprocal vertical motion to the movable platen, and whereby the first and second gimbal joints are configured to cooperatively isolate the ballscrew apparatus from offset and moment loading that may occur during press operation.

2. A mechanical press drive as defined in claim 1 in which:

the first gimbal joint couples the screw to the output of the drive motor; and, the second gimbal joint couples the nut to the movable platen of the press.

3. A mechanical press drive as defined in claim 2 in which the second gimbal joint comprises:

an inner trunion pivotally coupled to the nut;

an outer trunion pivotally coupled to the inner trunion; and a lower mount coupled to the outer trunion and configured to connect to the upper platen of the press.

4. A mechanical press drive as defined in claim 1 in which the first gimbal joint couples the output of the motor to the elongated screw, the first gimbal joint comprising:

an inner trunion pivotally coupled to the elongated screw;

an outer trunion pivotally coupled to the inner trunion; and an upper mount coupling the outer trunion to the output of the motor.

5. A mechanical press drive as defined in claim 4 in which the output of the motor comprises:

a thrust shaft connected at an upper end to a lower end of the driveshaft and connected at a lower end to the upper mount; and a thrust bearing configured to rotatably support the thrust shaft on the crown of the press while isolating the gearbox from compressive forces generated by the ballscrew apparatus.

6. A mechanical press drive as defined in claim 1 in which the motor output is coupled to a gearbox, an output of the gearbox is coupled to a driveshaft, and the driveshaft is coupled to the screw.

* * * * *

UNITED STATES PATENT AND TRADEMARK OFFICE

CERTIFICATE OF CORRECTION

PATENT NO. : 6,615,712 B2
DATED : September 9, 2003
INVENTOR(S) : Faitel et al.

It is certified that error appears in the above-identified patent and that said Letters Patent is hereby corrected as shown below:

Column 3,
Line 38, replace “43” with -- 42 --.
Line 52, replace “upper and lower” with -- lower and upper --.

Signed and Sealed this

Thirteenth Day of January, 2004

JON W. DUDAS
*Acting Director of the United States Patent and Trademark Office*